US005697852A

United States Patent [19]

Adelson et al.

[11] Patent Number: 5,697,852

[45] Date of Patent: Dec. 16, 1997

[54] METHOD AND MEANS FOR PACKAGING CUE TIP CHALK

[76] Inventors: Michael L. Adelson, 11835 Olympic Blvd., #1235, Los Angeles, Calif. 90064; Philip A. Sardo, 4537 Sepulveda Blvd., Sherman Oaks, Calif. 91403

[21] Appl. No.: 786,739

[22] Filed: Jan. 27, 1997

[51] Int. Cl.[6] ..... A63D 15/16

[52] U.S. Cl. ..... 473/36

[58] Field of Search ..... 473/35, 36, 37, 473/38, 39

[56] References Cited

U.S. PATENT DOCUMENTS

| | | | |
|---|---|---|---|
| 81,947 | 9/1868 | Ritchel | 473/36 |
| 221,164 | 11/1879 | Fautz | 473/35 |
| 363,898 | 5/1887 | Labre | 473/36 |
| 1,194,212 | 8/1916 | Moore | 473/39 |
| 1,556,064 | 10/1925 | Becker et al. | 473/36 |
| 1,688,310 | 10/1928 | Miller | 473/36 |

FOREIGN PATENT DOCUMENTS

| | | | |
|---|---|---|---|
| 799542 | 6/1936 | France | 473/35 |

*Primary Examiner*—William H. Grieb

[57] ABSTRACT

A method for packaging a cue tip chalk, involving cementing a chalk-impervious paper wrapper to the sides of a cube of chalk, leaving the ends of the cube exposed, and covering one of the exposed ends of the cube with a releasibly mounted cap, whereby chalk may be applied to a cue tip selectively from either end of the cube. When one end of the cube becomes excessively eroded through use, removing the cap from the other end exposes a new, fresh chalk surface. Alternatively, other wrapping materials, or a coating applied directly to the surface, may be used in place of a paper wrapper to cover the sides of the cube. Additionally, optional detent means are provided to help retain the cap during use of the chalk.

10 Claims, 1 Drawing Sheet

METHOD AND MEANS FOR PACKAGING CUE TIP CHALK

BACKGROUND OF THE INVENTION

1. Field of the Invention

This invention is related to chalk blocks of the type commonly used for applying chalky abrasive material to the tips of billiard and pool cues. More particularly it is concerned with an improved method and means for packaging such blocks. In billiard and pool parlance, the term "chalk" is used interchangeably to refer to the abrasive material and the dispenser, package, or device by means of which the material is retained and applied to the cue tip. In the absence of commonly accepted terminology for distinguishing between the two meanings, for purposes of this specification we shall endeavor to make our meaning clear from the context in which the term is used.

2. Prior Art

Conventionally, cue tip chalk blocks are made by mixing finely ground silica sand in water with a coloring agent and a binder to form a clay-like slurry. The mixture is spread in a sheet of uniform thickness and cut into cubes which are fired in an oven to harden, cooled, and in most instances, drilled to provide a shallow indentation in their top face. Each cube is then tightly encased in a paper wrapper that is cemented to and covers its bottom and all but a narrow region along the upper edge of its four sides. The top of the cube and the upper edge of the four sides are left exposed. The wrapper serves several purposes: First and foremost, it prevents the chalk from soiling the players' fingers and clothing, the billiard or pool table, and anything else it contacts. At the same time, it insures the player a reliable grip on the chalk block. Additionally, it affords protection against the block's chipping or breaking on impact.

To achieve the ball control needed to play billiards or pool well, it is important that the chalk cover not only the slightly domed face of the resilient felt or leather cue tip, but the leading edge of the tip surrounding the face as well. In applying chalk to a cue, most players hold the exposed face of the chalk block against the cue tip with light to moderate force and rotate either the cue or the block to transfer the desired coating onto the tip. The circular indentation referred to earlier helps keep the tip centered on the exposed face and facilitates the first few uses of a new chalk.

Even when only light force is applied to the chalk block, repeated uses quickly leave the cube deeply worn. Some players take pains to keep the eroded depression as narrow as possible, applying chalk to the tip by rotating the chalk block in a conical path around the axis of the cue stick. This method is effective until the cue tip nears the center of the cube. At that point, the walls of the block prevent the conical depression from being deepened without narrowing the conical angle. For players who employ this technique, the chalk block becomes virtually useless and must be discarded. Other players apply the chalk with a more or less flat, circular motion. Their use of the chalk enlarges the eroded region laterally as well as downwardly until eventually the cue tip breaks or threatens to break through one or more of the sides of the block. At this point once again the chalk block can no longer be used and commonly is discarded. In both instances, the block is discarded because it can no longer be used, not because the chalk has been used up. To the contrary, in practice the discarded block generally contains a substantial amount of unused chalk, frequently as much as or more than has been used Although individual chalk blocks are by their nature disposable and not particularly expensive, with the emergence of pool and billiards as popular forms of entertainment and the accompanying advent of chains of very large, well-appointed, modern pool and billiard establishments, replacing them represents a significant operating expense. A method or means for extending the life of the chalk block would represent a potentially large and welcome saving.

A variety of alternative designs and constructions for chalk blocks, chalk packaging, and chalking devices have been proposed. Typical of these are U.S. Pat No. 81,947 to Ritchel, U.S. Pat. No. 221,164 to Fautz, U.S. Pat. No. 363,898 to Labre, U.S. Pat. No. 1, 556,064 to Becker et al., and U.S. Pat. No. 1,688,310 to Miller. Without exception, all of the previous devices have proven to be too expensive to manufacture, too intricate for popular use, too difficult to inventory and dispense, or too impractical to exploit commercially. None of the prior art improvements on the basic, paper-wrapped cube with a single exposed end has achieved any degree of acceptance.

Against this background, it is a principal object of our invention to address the underlying problem, that is, the need to replace chalk blocks frequently, by providing a method and means for substantially increasing the useful life of the ordinary chalk block. A more specific object of the invention is to provide a method and means for packaging a more or less conventional chalk block which will extend the life of the block without greatly increasing its cost. Still another object is to provide a novel method and means for such packaging that overcomes the deficiencies inherent in the aforementioned prior art methods, means, designs, constructions, and devices.

Other objects and advantages of our invention will become apparent from the following summary of the invention and detailed description of its preferred embodiments.

SUMMARY OF THE INVENTION

Our method for packaging a chalk block comprises the steps of providing a more or less conventional cube of chalk; covering at least two opposed sides, and preferably all four sides, of the cube with a chalk-impervious wrapper of paper or the like, leaving the two ends of the cube exposed; optionally forming a depression in each exposed end to facilitate initiating the application of chalk to a cue tip; and providing with the block a chalk-impervious cap sized and configured to be releasably mounted alternatively to one or the other of the exposed ends of the cube, whereby chalk can be applied to a cue tip selectively from either end of the cube. The means, of course, comprises the cube so covered on at least two, and preferably four sides and having a selectively mountable cap covering one or the other of its exposed ends.

For a fuller understanding of the invention, reference is made to the following detailed description of the preferred embodiments illustrated in the accompanying drawings, in which:

BRIEF DESCRIPTION OF THE DRAWINGS

Wherever practicable, the same numeral is used to identify identical or substantially similar features appearing in the several figures.

DETAILED DESCRIPTION OF THE PREFERRED EMBODIMENTS

Figure 1:
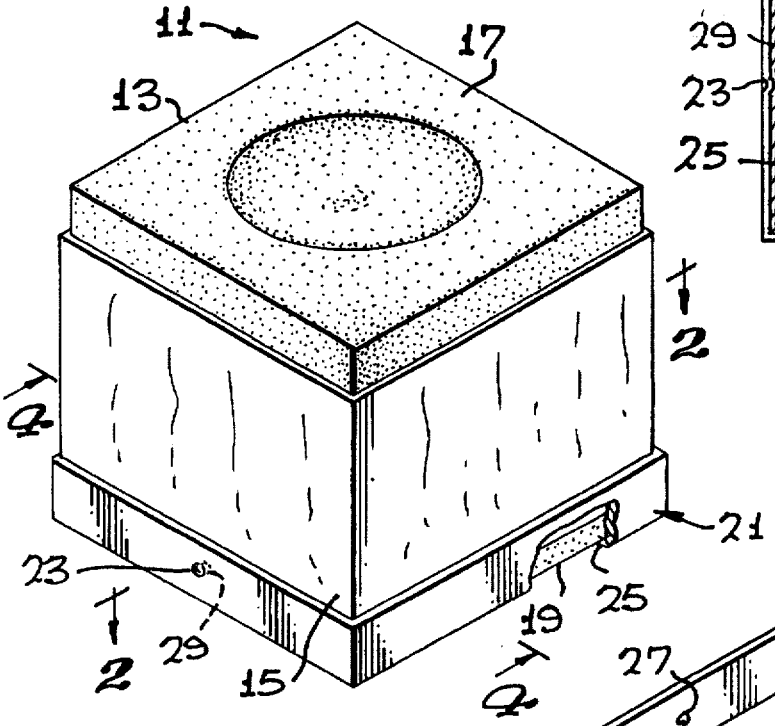
FIG. 1 is a top perspective view of a chalk block in accordance with the invention, with portions cut away to expose its construction.

Referring to FIG. 1, the dispenser or chalk 11 of our invention comprises a generally cubical block of chalky material 13 produced by conventional methods. It should be understood that the source, composition, and manufacture of the chalk cube form no part of the invention. Likewise, although we have chosen to illustrate the invention as it applies to the typical cubical form of chalk dispenser, it will become apparent that the invention can be adopted readily to provide a chalk of any desired geometric configuration.

As with prior art chalk dispensers, a chalk-impervious covering is applied to the block 13. In our preferred embodiment, the covering is a wrapper 15 of paper, synthetic film, foil, or other suitable material permanently cemented to the underlying surface. Alternatively, it could be a film or coat sprayed or deposited in liquid form on the surface of the block 13.

Unlike the coverings of conventional dispensers, our covering is applied only to the sides of the block 13. For grasping purposes, only two opposite sides of the block 13 need be covered, but for a variety of reasons, we prefer to apply wrapper 15 to all of the sides. In any case, the two ends 17, 19 of block 13 are left exposed.

Figure 2:
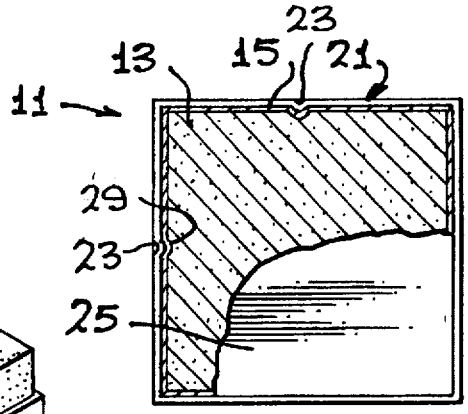
FIG. 2 is a reduced, partially cut-away sectional view of the chalk block shown in FIG. 1, taken in the direction 2—2.
Figure 3:
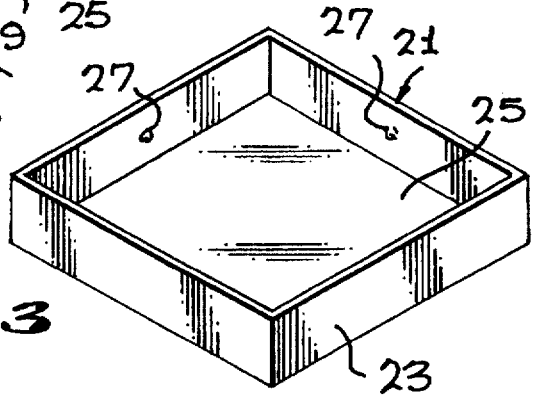
FIG. 3 is a reduced top perspective view of the end cap shown in FIG. 1.

As best seen in FIGS. 1–3, a cap 21 is sized and configured to be releasably mounted to the chalk 11 and serve as a cover for the ends 17, 19 of block 13. Cap 21 may be of paper, compressed pulp, molded plastic, machined or formed metal, wood, or any other suitable natural, man-made, or processed material. It may be rigid or flexible. Advantageously, it may be resilient and have a surface adapted for frictional gripping of the surface to which it is mounted. In the illustrated embodiments, the sides of block 13 are not entirely covered by wrapper 15. Conventionally, a narrow band of chalk is left exposed at both ends of each side. Cap 21 may be adapted to mount to this strip of exposed chalk, or to extend beyond the strip and mount to the covered region of chalk 11. We prefer to have the wall 23 of cap 21 overlap the edge of wrapper 15 when the block 13 is seated on the floor 25 of cap 21. This arrangement affords the maximum protection to the capped end of block 13 and effectively encapsulates the adjacent exposed end of the block 13 until it is to be used. If desired, detent means, such as bosses 27 in walls 23 and corresponding dimples 29 in chalk 11, may be provided to retain the cap 21 securely in place.

Figure 4:
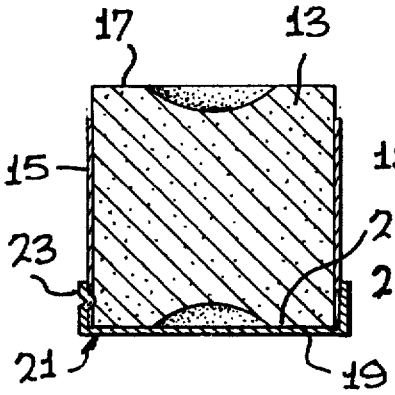
FIG. 4 is a reduced cross-sectional view through the central portion of the chalk block shown in FIG. 1, taken in the direction 4—4.
Figure 5:
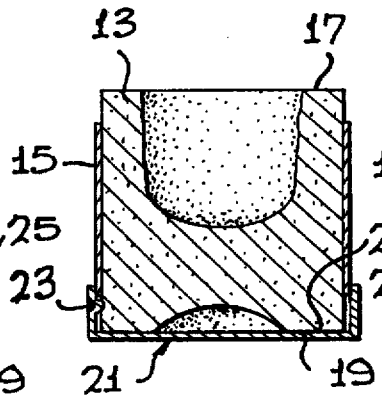
FIG. 5 is a cross-sectional view of a chalk block similar to the block shown in FIG. 4, as it might appear after a period of use.
Figure 6:
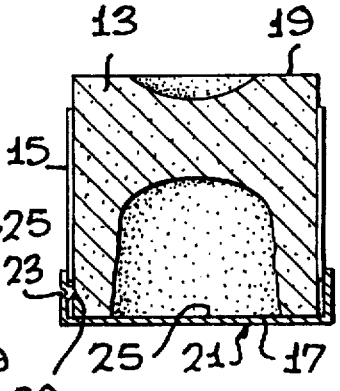
FIG. 6 is a cross-sectional view of the chalk block shown in FIG. 5, as it would appear after the block has been inverted and the cap placed on its opposite end.

FIGS. 4–6 illustrate the utility of the invention. As shown in FIGS. 1 and 4, a freshly manufactured chalk 11 in accordance with our invention is virtually indistinguishable from a conventional prior art chalk, save for the appearance of the cap 21 secured to one of its ends 19. The player uses the chalk 11 in exactly the same manner as he would a conventional dispenser, applying chalk to his cue tip at the exposed end 17 of block 13.

As shown in FIG. 5, after repeated uses end 17 becomes worn to the extent that the contour of the wall of the eroded cavity 31 makes it difficult or impossible to apply a uniform coating of chalk to the cue tip. At this point, rather than discard the chalk as would have been done with a conventional dispenser, the player merely removes the cap 21 from the end 19 and slips it onto end 17. FIG. 6 depicts the chalk 11 as it now appears, with end 17 capped to hide any trace of its earlier use and end 19 presenting a fresh, new, untouched surface.

Many of the advantages afforded by the novel features of the subject invention will be readily apparent from the foregoing description. It should be understood, however, that although the invention has been described in terms of the specific constructions shown in the drawings and described in the specification, it is not to be construed as limited to those embodiments. They are to be regarded is illustrative rather than restrictive. This specification is intended to encompass any and all variations and equivalents of the examples chosen for purposes of the disclosure, which do not depart from the spirit and scope of the following claims.

What is claimed is:

1. A method for packaging a cue tip chalk, comprising:

providing a generally cubical block of chalk;

applying a chalk-impervious covering to opposite sides of the cube, leaving the two opposite ends of the cube exposed; and covering one of the exposed ends of the cube with a releasibly mounted chalk-impervious cap, whereby chalk may be applied to a cue tip selectively from either end of the cube.

2. The method defined by claim 1, comprising applying the chalk-impervious covering to all sides of the cube.

3. The method defined by claim 1, wherein the chalk-impervious covering is a wrapping cemented to the sides of the cube.

4. The method defined by claim 1, wherein the chalk-impervious covering is a coating applied directly to the surface of the cube.

5. The method defined by claim 1, comprising providing cooperating cap-retaining detent means on the cap and on the cube.

6. A cue tip chalk, comprising:

a generally cubical block of chalk having a chalk-impervious covering on its opposite sides and having its opposite ends exposed; and a chalk-impervious cap releasably mounted to the cube covering one of its ends, whereby chalk may be applied to a cue tip selectively from either end of the cube.

7. The cue tip chalk defined by claim 6, comprising a chalk-impervious covering on all sides of the cube.

8. The cue tip chalk defined by claim 6, comprising a chalk-impervious wrapping cemented to the sides of the cube.

9. The cue tip chalk defined by claim 6, comprising a chalk-impervious coating applied directly to the surface of the cube.

10. The cue tip chalk defined by claim 6, comprising cooperating cap-retaining detent means on the cap and on the cube.

* * * * *